US007621005B1

(12) United States Patent
Harvey

(10) Patent No.: US 7,621,005 B1
(45) Date of Patent: Nov. 24, 2009

(54) PORTABLE SUNBATHING MAT AND BEACH BAG

(76) Inventor: Lillian Harvey, 170 SW. 53rd St., Cape Coral, FL (US) 33914

( * ) Notice: Subject to any disclaimer, the term of this patent is extended or adjusted under 35 U.S.C. 154(b) by 0 days.

(21) Appl. No.: 12/319,036

(22) Filed: Dec. 31, 2008

Related U.S. Application Data

(60) Provisional application No. 61/009,540, filed on Dec. 31, 2007.

(51) Int. Cl.
*A47C 27/14* (2006.01)
*A47G 9/00* (2006.01)

(52) U.S. Cl. ..... 5/419; 5/420; 5/725; 5/503.1; 5/922

(58) Field of Classification Search ..... 5/419, 5/417, 420, 738, 725, 636, 638, 640, 690, 5/922, 503.1
See application file for complete search history.

(56) References Cited

U.S. PATENT DOCUMENTS 4,231,125 A * 11/1980 Tittl ..... 5/419
5,022,107 A * 6/1991 Knotts ..... 5/419
5,110,219 A 5/1992 Lopes
5,481,767 A 1/1996 Lewis
5,629,071 A 5/1997 Feldman
D381,199 S 7/1997 Glasser
5,730,529 A 3/1998 Fritz et al.
D409,382 S 5/1999 Erlanson
6,061,849 A 5/2000 Seals
6,185,765 B1 * 2/2001 High ..... 5/419
6,276,828 B1 8/2001 Otley et al.
7,225,483 B1 * 6/2007 Remblad ..... 5/417

* cited by examiner

*Primary Examiner*—Alexander Grosz
(74) *Attorney, Agent, or Firm*—Robert C. Montgomery

(57) ABSTRACT

A bed-like apparatus particularly for use at the beach comprising a large rectangular padded section with an integral pillow is herein disclosed. The pillow section can be rolled and secured with fasteners into a large torus-shaped roll allowing a user to lie in a prone position comfortably. The apparatus comprises a water-resistant material affixed to a lower surface and a terrycloth type material along a top surface similar in size to a beach towel, further comprising an integral pocket and a beverage holder. A carrying handle and straps are used for ease of transportation while providing a large water-resistant storage compartment along an external surface for storage of sunscreen, food, books, refreshments, and the like.

19 Claims, 5 Drawing Sheets

PORTABLE SUNBATHING MAT AND BEACH BAG

RELATED APPLICATIONS

The present invention was first described in U.S. Provisional Patent Application No. 61/009,540 filed on Dec. 31, 2007, the entire disclosures of which are incorporated herein by reference.

FIELD OF THE INVENTION

The present invention relates generally to a sunbathing mat comprising an upper and lower cover member enveloping a torso pad, an adjustable head and neck rest, a plurality of storage pockets, a beverage holder, and a means for converting the sunbathing mat into a configuration for transportation.

BACKGROUND OF THE INVENTION

Very few leisure time activities rival that of spending a warm summer day at the beach. Whether the beach is at an ocean or a small lake, the feeling that comes with being outside and near water is an enjoyable one. Most people usually bring a large assortment of supporting items with them while on the beach such as towels, books, music players, radios, and food. All of these items must be transported from their cars, bicycles or beach homes to the beach itself. This often dictates many repeat trips when arriving at the beach and an equal number of trips when leaving. Additionally, many people find the comfort and padding afforded by beach towels unsatisfactory, thus forcing the user to bring cots, large chaise lounges, and other large bulky items. The development of the present device fulfills this need.

Several attempts have been made in the past to provide an all-in-one beach bag and sunbathing mat. U.S. Pat. No. 5,110,219 issued in the name of Lopes discloses a combination beach mat and tote bag comprising a foldable beach mat with anchors to secure to a ground surface and carrying handles when used as a tote bag. Unfortunately, the Lopes design does not comprise an adjustable head and neck rest portion and a beverage holder on an upper cover or a removable upper and lower cover for a torso pad as disclosed in the present invention.

U.S. Pat. No. 5,481,767, issued in the name of Lewis discloses a multipurpose beach blanket providing a pillow and a support carrier, a plurality of storage pockets, a handle, and adjustable storage pockets. Unfortunately, the Lewis design does not comprise an adjustable head and neck rest portion and a beverage holder on an upper cover or a removable upper and lower cover for a torso pad as disclosed in the present invention.

U.S. Pat. No. 5,629,071, issued in the name of Feldman describes a beach towel convertible into a bag for carrying various accessories. Unfortunately, the Feldman design does not comprise an adjustable head and neck rest portion and a beverage holder on an upper cover as disclosed in the present invention.

U.S. Pat. No. 5,730,529, issued in the name of Fritz et al. discloses a combination beach mat and carrying device with a pillow section and several storage sections and a binding carrying strap. Unfortunately, the Fritz et al. design does not comprise an adjustable head and neck rest portion and a beverage holder on an upper cover or a removable upper and lower cover for a torso pad as disclosed in the present invention.

U.S. Pat. No. 6,061,849, issued in the name of Seals describes a beach towel with built-in pockets and carrying handle. Unfortunately, the Seals design does not comprise an adjustable head and neck rest portion and a beverage holder on an upper cover or a removable upper and lower cover for a torso pad as disclosed in the present invention.

U.S. Pat. No. 6,276,828, issued in the name of Otley et al. discloses a beach towel that converts into a compact tote bag with externally accessible pockets and further comprising a flexible absorbent fabric and a multi-paneled towel. Unfortunately, the Fritz et al. design does not comprise an adjustable head and neck rest portion and a beverage holder on an upper cover or a removable upper and lower cover for a torso pad as disclosed in the present invention.

The prior art appears to disclose various combination beach tote bags and beach mats. However, none of the prior art particularly describes a combination beach bag and sunbathing mat having a torso pad protected by a removable upper cover thereto a lower cover and an adjustable neck and head rest and further comprising storage pockets, a beverage holder, and a means to secure the sunbathing mat in a rolled configuration for ease of portability.

SUMMARY OF THE INVENTION

An aspect of the present invention is to provide a sunbathing mat, comprising a base assembly comprising a neck region and a foot region, a pillow assembly affixed thereto an upper end thereof said base assembly, a plurality of storage means integral therewith said base assembly; and a securing and transportation means for securing said sunbathing mat thereinto a rolled configuration.

An object of the sunbathing mat provides a pillow assembly to be configurable between a straight configuration and a ring-shaped configuration.

An object of the sunbathing mat provides a rolled configuration, thereby providing an ease of transporting said sunbathing mat.

Another aspect of the sunbathing mat provides an upper base cover, a lower base cover removably attachable to the upper base cover therewith a base cover fastener, and a torso pad for removable placement therebetween the upper base cover and the lower base cover.

An object of the upper base cover is to provide a protective and comfortable upper enclosure to the torso pad.

Yet another aspect of the upper cover further comprises a terrycloth material and to further comprise at least one (1) of the following list: a variety of colors, a variety of patterns, a logo, or personalized indicia.

An object of the lower base cover is to provide a protective cover to the torso pad from ground surfaces.

Yet another aspect of the lower base cover further comprises a rugged water-proof material, an abrasion resistant material thereon an outer surface and to further comprise at least one (1) of the following list: a variety of colors, a variety of patterns, a logo, or personalized indicia.

An object of the torso pad is to comprise dimensions enabling a close fit therebetween the upper base cover and the lower base cover when interconnected therewith said base cover fastener.

An aspect of the base cover fastener is to be affixed along an outer perimeter region of the upper base cover and an outer perimeter region of the lower base cover comprising a starting position adjacent to the neck region and terminating at the foot region.

An aspect of the pillow assembly further comprises a pillow pad attached to a central location of the neck region of the torso pad and comprising a cylindrical shape, a pillow pad cover, and a pair of pillow assembly fasteners affixed along outer end panels of the pillow cover.

An object of pillow cover is to provide a protective and comfortable enclosure to the pillow pad.

Another object of pillow cover is to comprise a terrycloth material having at least one (1) of the following list: a variety of colors, a variety of patterns, a logo, or personalized indicia.

An object of the pair of extension sections is to provide a protective and comforting means thereto a user from ground surfaces.

An object of the pillow assembly fasteners is to provide a means of securing the pillow assembly in a ring-shaped configuration.

Another aspect of the pillow pad comprises a neck region cover portion, a pair of pillow cover fasteners extending along a forward edge adjacent thereto the base assembly and terminating at an outer edge of the neck region cover portion, and a pair of extension sections each comprising a generally triangle-shaped panel extending therefrom opposing upper horizontal edges of the upper base cover and securable with an extension section fastener to opposing lower outer surfaces of the pillow pad cover.

An object of the pillow pad is to comprise a close fit within the pillow pad cover when secured with the pair of pillow cover fasteners.

An aspect of the sunbathing mat comprises a torso pad and pillow pad comprising a polyurethane foam material and further comprising a unitary construction being partially separated from one another at the neck region.

An aspect of the plurality of storage means comprises a beverage holder located at an intermediate location adjacent to an edge of the upper base cover and a beverage aperture through the torso pad for receiving the beverage holder.

Another aspect of the plurality of storage means comprises a pocket located at an opposing intermediate location from the beverage holder, further comprising a fastening securable with a pocket fastener.

Yet another aspect of the plurality of storage means comprises a storage compartment located thereon the foot region at a central location at an outer surface of the lower base cover, securable with a storage compartment fastener extending between upper lateral extremities of the storage compartment, such that the storage compartment is readily accessible when the sunbathing mat is in the rolled configuration.

An aspect of the securing and transportation means is to further comprise a handle affixed to outer edges thereof the lower base cover, a length adjuster located at a central position upon the handle, a pair of straps each with a proximal end extending perpendicularly to the handle from a lower edge of the lower base cover on opposing sides and a strap fastener at a distal end, and a pair of lower base cover fasteners located on the foot region of an outer surface of the lower base cover.

An object of the length adjuster is to provide a length adjustment means for the handle.

An object of the strap fastener of each of the pair of straps is to correspondingly mate with a lower base cover fastener when in the rolled configuration.

Another aspect of the sunbathing mat comprises a heavy-duty waterproof bi-directional zipper for the base cover fastener, the pair of pillow cover fasteners, and the storage compartment fastener.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | portable sunbathing mat and beach bag |
| 20 | base assembly |
| 21 | upper base cover |
| 22 | lower base cover |
| 23 | base cover fastener |
| 24 | slider |
| 25 | pocket |
| 26 | fastening flap |
| 27 | beverage holder |
| 28 | beverage holder liner |
| 29 | pocket fastener |
| 30 | pillow assembly |
| 31 | pillow pad cover |
| 32 | pillow assembly fastener |
| 33 | neck region cover |
| 34 | pillow cover fastener |
| 35 | extension section |
| 36 | extension section fastener |
| 37 | neck cover fastener |
| 38 | beverage holder cup |
| 40 | pad assembly |
| 41 | torso pad |
| 42 | pillow pad |
| 43 | neck region |
| 44 | beverage aperture |
| 50 | handle |
| 51 | length adjuster |
| 52 | strap |
| 53 | strap fastener |
| 54 | storage compartment |
| 55 | compartment fastener |
| 60 | beverage |

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 1:
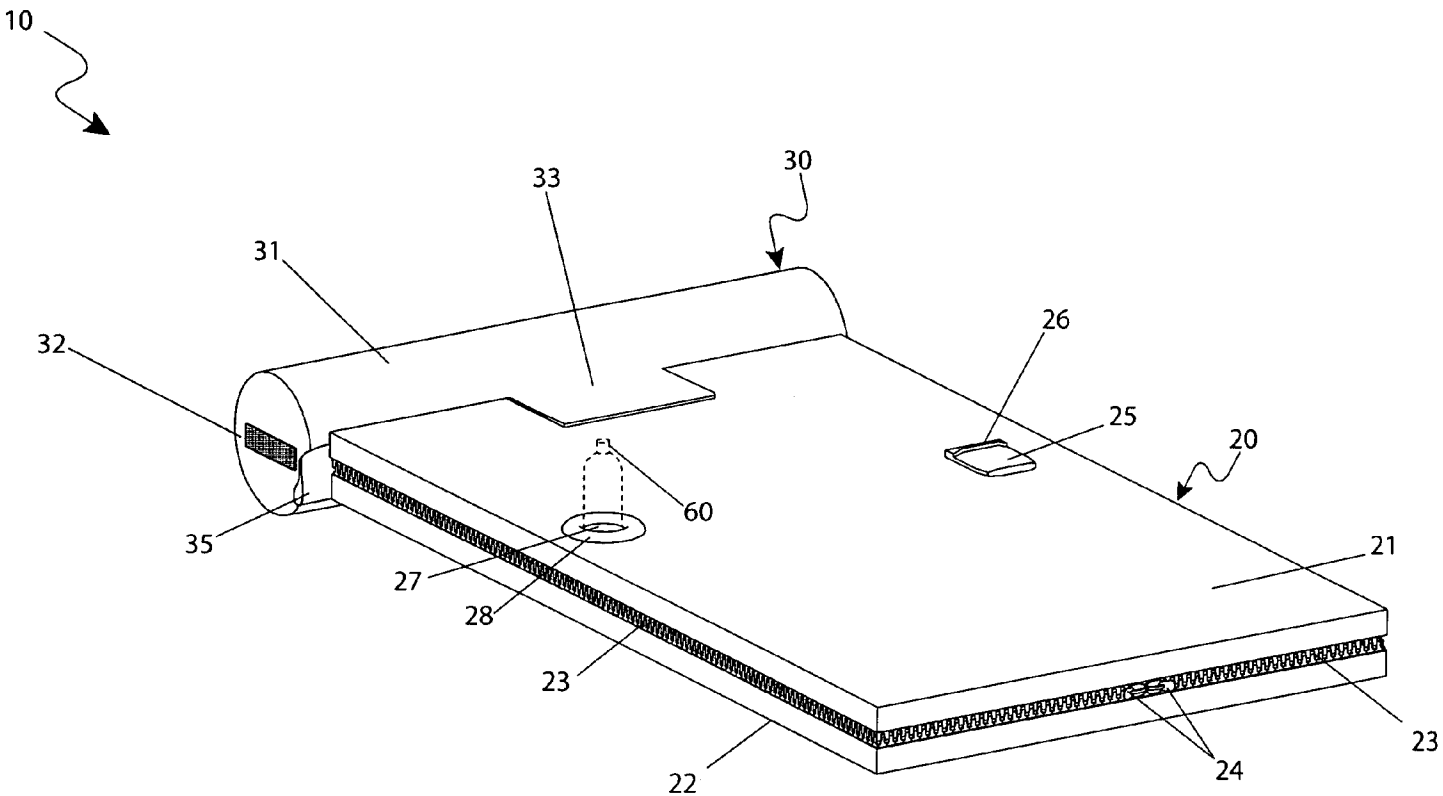
FIG. 1 is a top perspective view of a portable sunbathing mat and beach bag 10, according to a preferred embodiment of the present invention.
Figure 2:
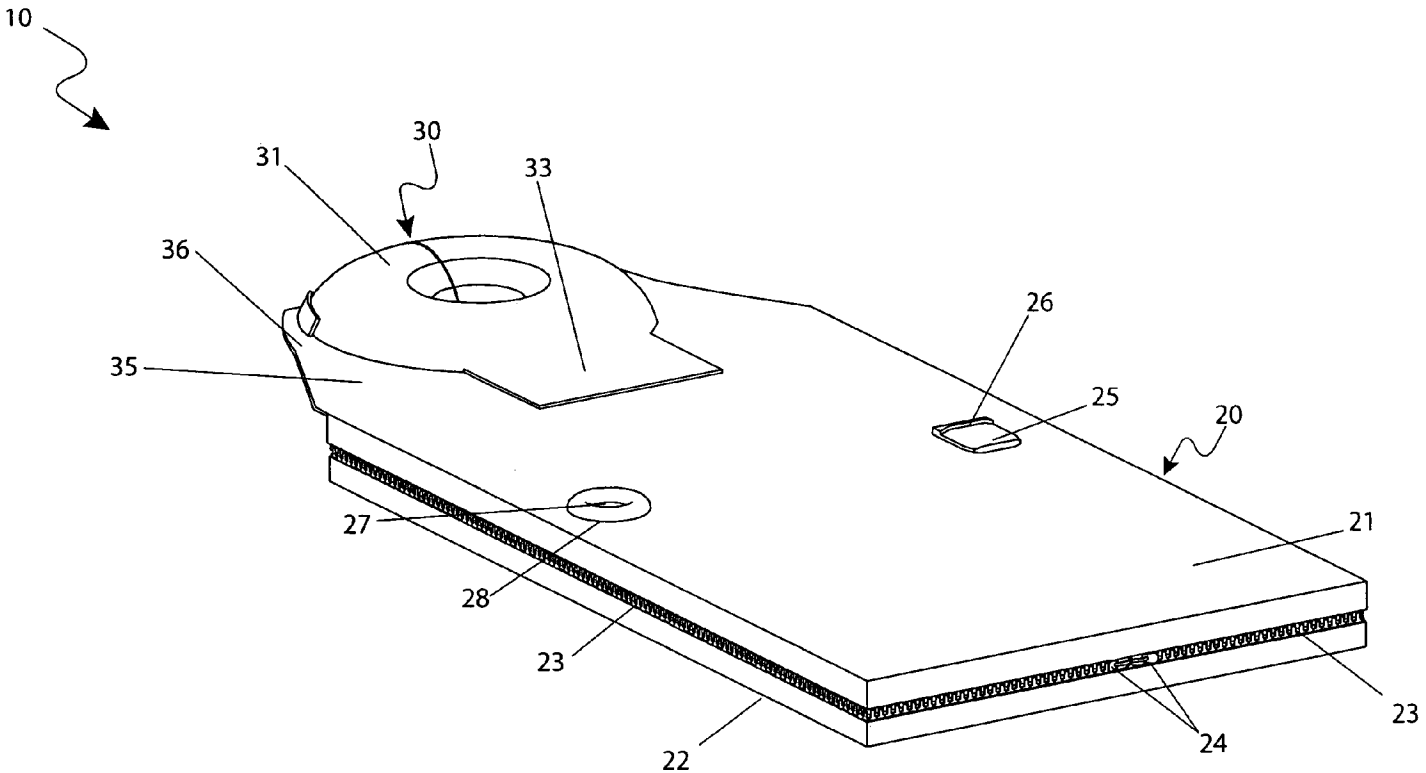
FIG. 2 is a top perspective view of the portable sunbathing mat and beach bag 10 depicting an alternate ring-shaped configuration of a pillow assembly 30.
Figure 5:
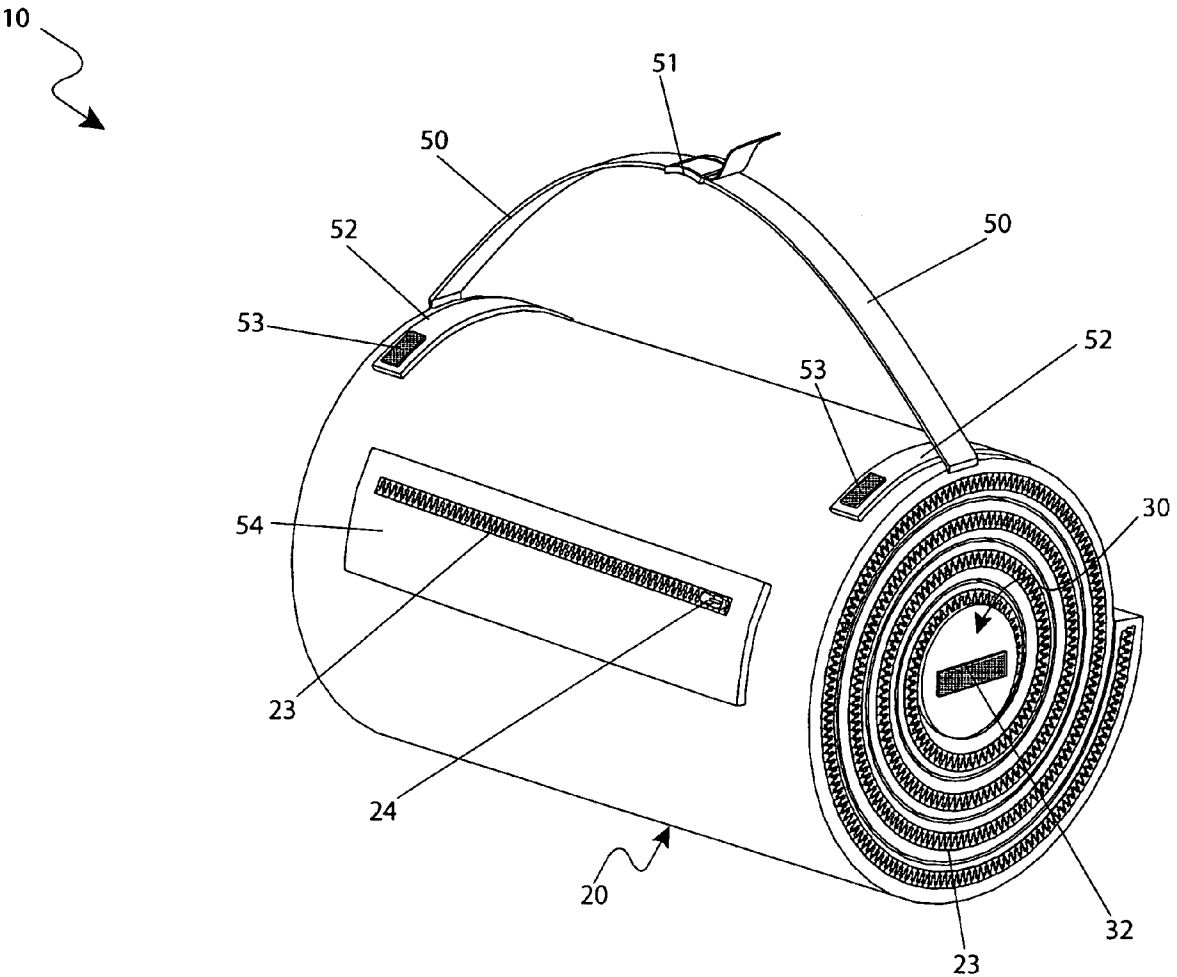

The present invention describes a portable sunbathing mat and beach bag (herein described as the "apparatus") 10, which provides a means for a bed-like apparatus for use at a beach that comprises a large padded base assembly 20 with an integral pillow assembly 30. The pillow assembly 30 can be configured to form a torus-shaped roll allowing a user to lie comfortably in a prone position and is secured via corresponding pillow assembly fasteners 32. The apparatus 10 comprises a water-resistant lower base cover 22 and a terry-cloth-type upper base cover 21. An integral pocket 25 to secure personal items and a beverage holder 27 are integrated into the base assembly 20. A carrying handle 50 is provided for ease of transportation, a plurality of straps 52 are used to secure the apparatus 10 in a rolled configuration, and a large water-resistant storage compartment 54 is further provided along an external surface for storage of sunscreen, food, books, refreshments, and the like. Referring now to FIGS. 1 and 2, top perspective views of the apparatus 10, according to the preferred embodiment of the present invention, is disclosed. The apparatus 10 generally comprises a base assembly 20, a pillow assembly 30, and a neck region 43. The base assembly comprises a pad assembly 40 (see FIG. 3), an upper base cover. 21, and a lower base cover 22. The pillow assembly comprises a pillow pad 42 (see FIG. 3) and pillow pad cover 31. The apparatus 10 is preferably similar in size to a large beach towel and provides a portable bed-like surface to a user while lounging at a beach area, at home, or other desired location. The apparatus 10 comprises three (3) configurations. A first configuration is illustrated in FIG. 1 with the apparatus 10 comprising the base assembly 20 in a deployed and unrolled state and the pillow assembly 30 in a straight-line configuration which is intended to support the head and neck of the user when in a supine position. A second configuration is illustrated in FIG. 2 with the apparatus 10 comprising the base assembly 20 in a deployed and unrolled state and the pillow assembly 30 in a ring-shaped configuration which is intended to support the face and neck of the user when in a prone position. A third configuration is illustrated in FIG. 5 with the apparatus 10 comprising the base assembly 20 in a rolled-up and stowed configuration.

The upper base cover 21 provides a protective and comfortable top enclosure thereto the torso pad 41 (see FIG. 3) and comprises enhancements such as, but not limited to: a beverage holder 27 for holding common sized beverages 60, and a pocket 25 for storage of personal items therein. The upper base cover 21 provides a convenient removal means therefrom the torso pad 41, thereby allowing laundering or replacement of said upper base cover 21 as needed. The upper base cover 21 is envisioned to be made using conventional textile assembly techniques and a cotton terrycloth-type cover material; however, a person skilled in the art will appreciate that many other types of fabric may be used without deviating from the basic concept and as such should not be interpreted as a limiting factor of the present apparatus 10. The upper base cover 21 is further envisioned being introduced in a variety of colors, patterns, logos, personalized indicia, and the like based upon a user's preference.

The upper base cover 21 provides an attachment means thereto a lower base cover 22 via a base cover fastener 23. The base cover fastener 23 is illustrated comprising a heavy-duty dual-slider 24 bi-directional zipper made of durable water-proof materials such as stainless steel, brass, nylon, or the like being common in the industry; however, a person skilled in the art will appreciate that many other types of fasteners may be used without deviating from the basic concept, such as hook-and-loop, snaps, or the like and as such should not be interpreted as a limiting factor of the present apparatus 10. The base cover fastener 23 is sewn-in along an outer perimeter region of the upper base cover 21 and the lower base cover 22 thereupon all four (4) side surfaces of the base assembly 20 and comprises a starting position adjacent to the neck region 43 and terminating at a foot end of said base assembly 20.

The pocket 25 and the beverage holder 27 are located at opposing intermediate positions along outside edges of the upper base cover 21. The pocket 25 provides secure temporary storage of personal items in an expected manner and comprises a fastening flap 26. The fastening flap 26 is secured via a pocket fastener 29 (see FIG. 3) which is preferably two (2) corresponding sections of a hook-and-loop fastener located thereon opposing upper portions of the pocket 25 and said fastening flap 26. The beverage holder 27 comprises a flush-mounted cylindrical-shaped beverage holder liner 28 which is preferably a soft, flexible material, such as rubber or the like which provides some shape stiffening means to the beverage holder 27. The beverage holder 27 further comprises a sewn-in beverage holder cup 38 (see FIG. 3) which provides a lining feature to an inside diameter of a beverage aperture 44 in the pad assembly 40 (see FIG. 3) which is suitable to insert a common beverage container 60 therein. The beverage holder cup 38 protrudes perpendicularly downward therefrom said upper base cover 21 and provides a closed bottom.

The lower base cover 22 comprises a rugged water-proof textile surface comprising a similar shape as the upper base cover 21 while providing protection to the torso pad 41 from water or abrasive ground surfaces. The lower base cover 22 is preferably made using abrasion resistant materials such as vinyl, leather, rubber, polyurethane, or the like. The lower base cover 22 is provided in a variety of colors and patterns in a coordinated manner thereto the upper base cover 21.

Figure 3:
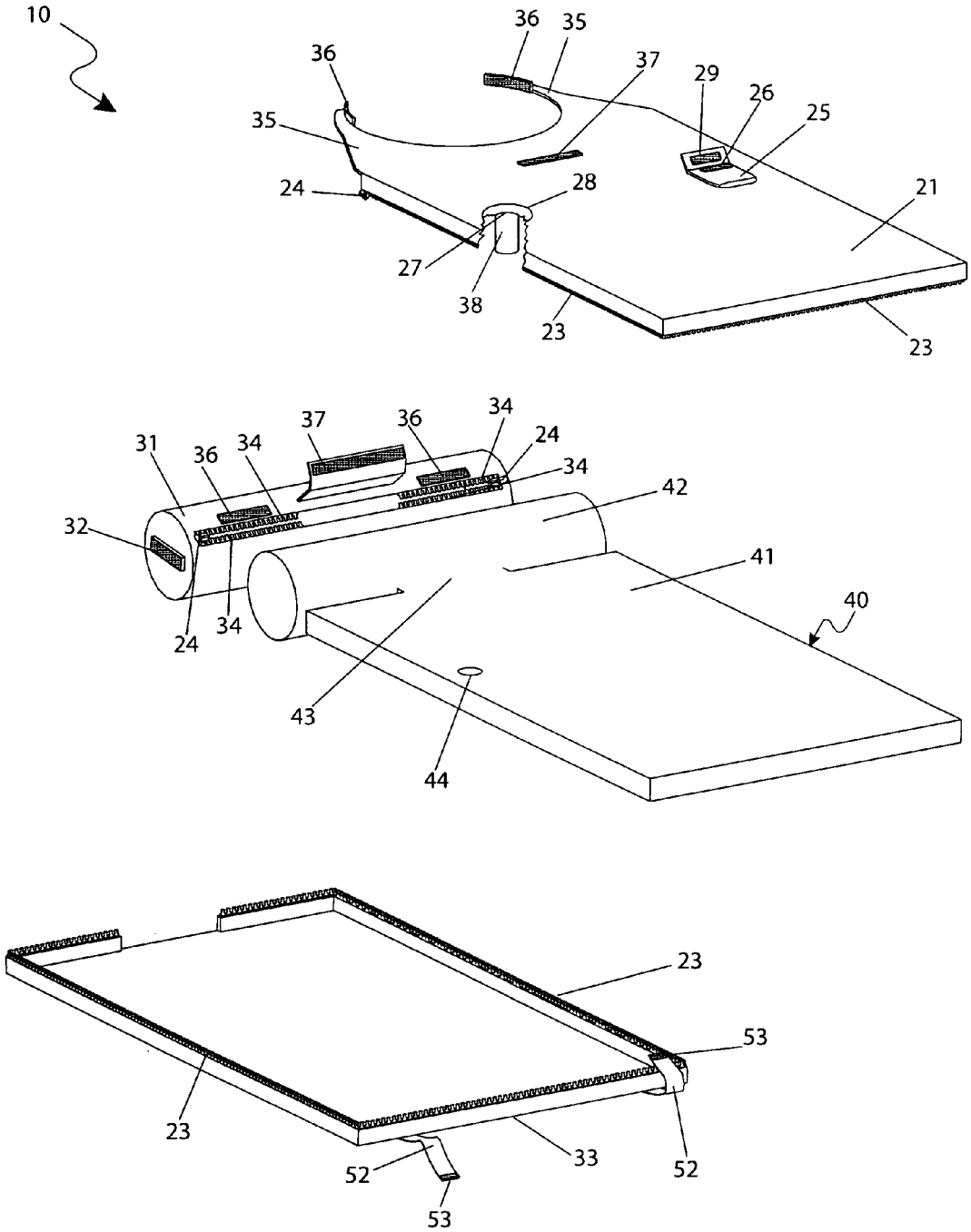
FIG. 3 is an exploded view of the portable sunbathing mat and beach bag 10, according to a preferred embodiment of the present invention.

Referring now to FIG. 3, an exploded perspective view of the apparatus 10, according to the preferred embodiment of the present invention, is disclosed. The pad assembly 40 comprises a torso pad 41, a pillow pad 42, a neck region 43, and a beverage aperture 44. The torso pad 41 is envisioned to be approximately two (2) to six (6) inches thick and having a general outline similar to that of a common beach towel. The torso pad 41 provides an attachment means thereto the pillow pad 42 via the neck region 43 located at an upper intermediate position. The torso pad 41 and pillow pad 42 are preferably a single molded or cut foam rubber shape being partially separated therefrom one another using a hot-knife device leaving the neck region 43 intact therebetween, with said neck region 43 being approximately eight (8) inches wide. It is understood that the torso pad 41 and the pillow pad 42 may be alternately affixed thereto one another using methods such as, but not limited to: adhesives, heat welding, sewing, or equivalent processing. The torso pad 41 and the pillow pad 42 are preferably made using common polyurethane foam materials or other suitable padding materials comprising one (1) or more laminated and bonded padded layers of varying densities. Furthermore, the torso pad 41 and the pillow pad 42 may be introduced using alternate padding materials such as polyester fibers, cotton, wool, hemp, or the like and as such should not be considered to be a limiting factor of the apparatus 10. The torso pad 41 further comprises a beverage aperture 44 comprising a round through-hole having a particular diameter as to allow insertion therein of the beverage holder cup 38 of the upper base cover 21. The pillow pad 43 is preferably approximately six (6) to ten (10) inches in diameter having an overall width similar to the torso pad 41.

The pillow pad cover 31 provides a protective and comfortable enveloping enclosure thereto the pillow pad 43 comprising similar materials and function as the aforementioned upper base cover 21. The pillow pad cover 31 comprises a pair of waterproof pillow cover fasteners 34. The pillow cover fastener 34 preferably comprises a bi-directional zipper and a heavy-duty slider 24 made of durable water-proof materials such as stainless steel, brass, nylon, or the like being common in the industry; however, a person skilled in the art will appreciate that many other types of fasteners may be used without deviating from the basic concept, such as hook-and-loop, snaps, or the like and as such should not be interpreted as a limiting factor of the present apparatus 10. The pillow cover fasteners 34 extend along a forward edge adjacent thereto the base assembly 20 and terminate at an outer edge of the neck region 43. The pillow cover 31 further comprises a pair of sewn-in pillow assembly fasteners 32 which are preferably corresponding sections of hook-and-loop fastener affixed using conventional textile techniques along outer end panels of the pillow cover 31. The pillow assembly fasteners 32 provide a means of securing the pillow assembly 30 when manually reshaped to form the ring or torus shape of the second configuration as depicted in FIG. 2.

The upper base cover 21 further comprises two (2) extension sections 35 which provide protection and comfort to the user's arm areas from sand or other abrasive surfaces while utilizing the apparatus 10 in the prone position as depicted in FIG. 2. Each extension section 35 provides a generally triangle-shaped fabric panel which extends therefrom an upper horizontal edge of the upper base cover 21 thereto a lower outer surface of the pillow pad cover 31. The extension sections 35 are preferably made using similar material as the aforementioned upper base cover 21. Each extension section 35 comprises an extension section fastener 36 thereon an upper end which removably attaches thereto corresponding extension section fasteners 36 thereon the lower outer surface of the pillow pad cover 31. The extension section fasteners 36 are preferably corresponding sections of hook-and-loop fasteners; however, a person skilled in the art will appreciate that many other fastening means may be used without deviating from the basic concept, such as snaps, integrally sewn-in panels being integral thereto the upper base cover 21 and the pillow pad cover 31, or the like and as such should not be interpreted as a limiting factor of the present apparatus 10. When the pillow assembly 30 is in the first configuration (see FIGS. 1 and 4), the extension sections 35 collapse and fold in a natural manner to occupy an area between said pillow assembly 30 and the base assembly 20. The pillow pad cover 31 further comprises a neck region cover 33 which provides a protective and comfortable cover to the neck region 43 of the pad assembly 40. The neck region cover 33 comprises a neck cover fastener 37 located thereon a bottom surface of a distal end of the same which removably attaches thereto a corresponding neck cover fastener 37 thereon a top surface of a central upper end of the upper base cover 21 adjacent to the neck region 43. The neck cover fastener 37 is preferably corresponding opposing sections of a hoop-and-loop fastener or the like.

Figure 4:
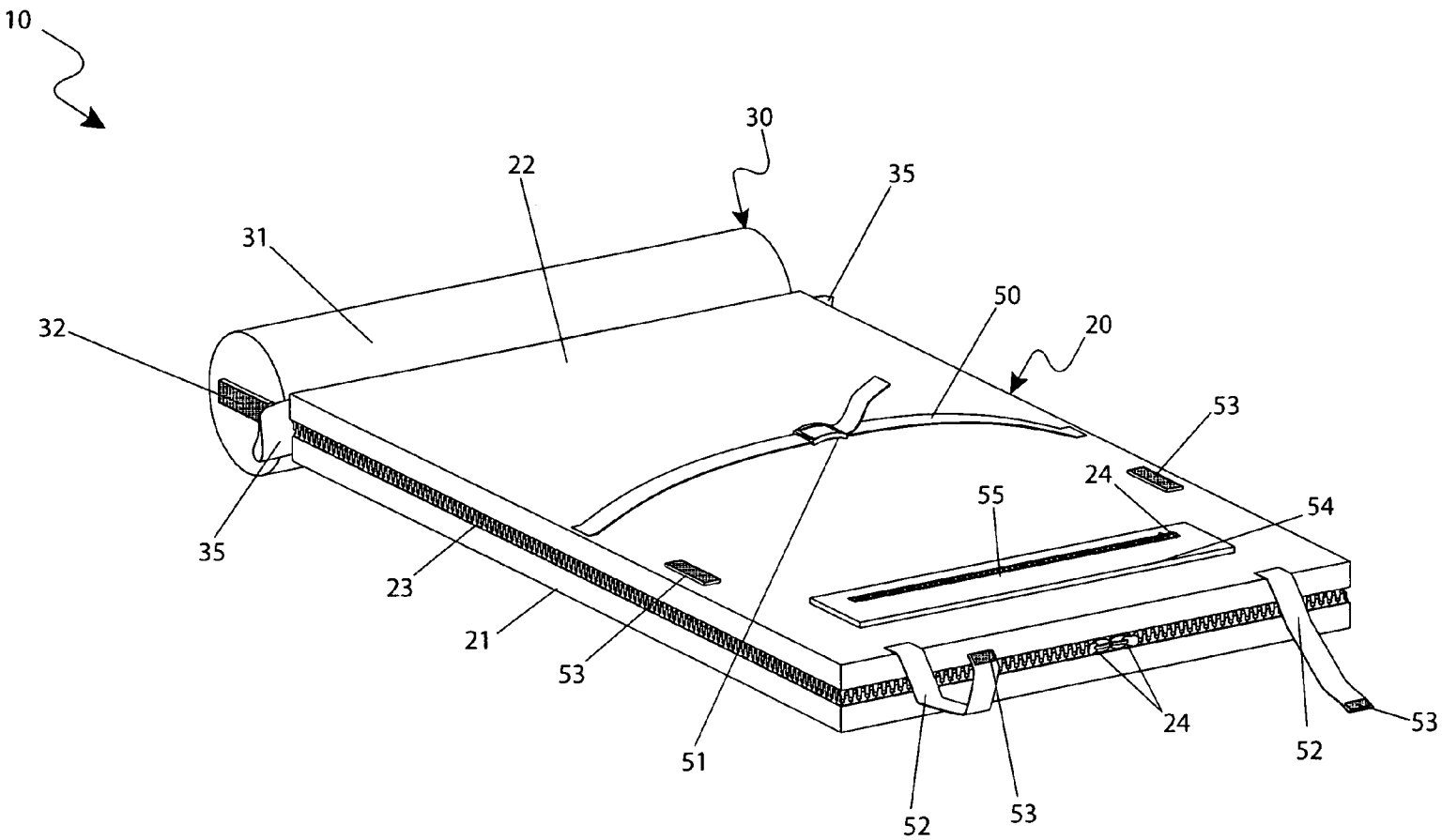
FIG. 4 is a bottom perspective view of the portable sunbathing mat and beach bag 10, according to a preferred embodiment of the present invention; and, FIG. 5 is a front perspective view of the portable sunbathing mat and beach bag 10, depicting a rolled-up and stowed configuration, according to a preferred embodiment of the present invention.

Referring now to FIG. 4, a bottom perspective view of the apparatus 10, according to the preferred embodiment of the present invention, is disclosed. The apparatus 10 is illustrated here in the first configuration. The lower base cover 22 comprises a handle 50, a length adjuster 51, a plurality of straps 52, and a storage compartment 54. The handle 50 comprises a rugged grasping appendage thereto a user providing a looping textile device affixed to outer edges of the lower base cover 22. The handle 50 is preferably made using strong strapping materials such as nylon webbing, polypropylene webbing, polyester webbing, a sewn fabric assembly, or the like being constructed and affixed thereto the lower base cover 22 using conventional sewing techniques, rivets, or other fasteners. The straps 52 extend perpendicular thereto the handle 50 therefrom a lower edge of the lower base cover 22. The strap 52 comprises a loose end which further comprises a strap fastener 53 on both a top and a bottom surface of a distal end of said strap 52. When in the first or the second configuration (see FIGS. 1, 2, and 4) the straps 52 can be flatly secured thereto the outer surface of the lower base cover 22 via removably attaching the strap fastener 53 located thereon the bottom surface of said straps 52 thereto corresponding strap fasteners 53 thereon a lower end of said lower base cover 22, thus keeping said straps 52 tucked under the apparatus 10 and out of the way. The strap fasteners 53 are preferably corresponding sections of a hoop-and-loop fastener, snaps, buckles, or the like. The straps 52 are preferably made using strong strapping materials such as nylon webbing, polypropylene webbing, polyester webbing, a sewn fabric assembly, or the like or may be provided being made of flexible strapping materials and being constructed and affixed thereto the distal end of the lower base cover 22 using conventional sewing techniques, rivets, or other fasteners.

The storage compartment 54 is located along the outer surface of the lower end of the lower base cover 22 and is affixed thereto using methods such as sewing, adhesives, rivets, or the like. The storage compartment provides an external enclosure for various items such as sunscreen, food, books, refreshments, and the like. The storage compartment 54 is preferably made using similar water-proof materials as the lower base cover 22. The storage compartment 54 further comprises a horizontal compartment fastener 55 extending between upper lateral extremities of said storage compartment 54. The compartment fastener 55 preferably comprises a bi-directional zipper and a heavy-duty slider 24 made of durable water-proof materials such as stainless steel, brass, nylon, or the like being common in the industry; however, a person skilled in the art will appreciate that many other types of fasteners may be used without deviating from the basic concept, such as hook-and-loop, snaps, or the like and as such should not be interpreted as a limiting factor of the present apparatus 10.

Referring now to FIG. 5, a front perspective view of the apparatus 10, depicting the third configuration, according to the preferred embodiment of the present invention, is disclosed. The apparatus 10 is illustrated here being compactly rolled up and in a stowed and carriable state. The rolling process having started at the pillow assembly 30 end and progressing toward a foot end of the base assembly 20 in an expected manner providing a compact stowed state. The apparatus 10 provides a convenient transportation and storage means using the described components. The handle 50 further comprises a length adjuster 51 located at a central position thereupon. The length adjuster 51 provides an adjustable length means and is envisioned to comprise a common plastic fitting such as a tri-glide, side-release buckle, or equivalent length adjusting device. When in the third configuration, the straps 52 form a continuous loop therearound the rolled apparatus 10 in a radial manner. Once rolled, the straps 52 provide a means of securing the apparatus 10 in the rolled state via removably attaching the strap fasteners 53 thereon the top surface of said strap 52 thereto the corresponding strap fasteners 53 thereon the lower base cover 53 (see FIG. 4).

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1, 2 and 5.

The method of utilizing the apparatus 10 may be achieved by performing the following steps: preparing the apparatus 10 for transportation by rolling said apparatus 10 starting at the pillow assembly 30 end and rolling toward the foot end of the base assembly 20 in an expected manner; fastening said apparatus 10 in the third configuration using the straps 52; fastening said straps 52 around said apparatus 10 using the strap fasteners 53; adjusting the handle 50 to a desired length using the length adjuster 51; retracting the compartment fastener 55; inserting items needed for a beach, other location, or activity therein the storage compartment 54; closing said compartment fastener 55; transporting said apparatus 10 to a desired area for sun-bathing, resting, or the like; unloading supplies therefrom said storage compartment 54 as needed; releasing said straps 52; unrolling said apparatus 10 to the first configuration upon a desired surface with the lower base cover 22 facing down; configuring the pillow assembly 30 in second configuration if a prone or "face-down" laying position is desired; securing a beverage 60 thereto the beverage holder 27; securely storing personal items and valuables in the pocket 25 using the fastening flap 26 as required; using said apparatus 10 to sunbath, sleep, rest, or the like as desired; rolling said apparatus 10 into said third configuration thus into a compact state; attaching said straps 52 as previously described; transporting and/or stowing said apparatus 10 until needed again; and, enjoying the compact portability of a comfortable bed-like apparatus 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A sunbathing mat, comprising:

a base assembly, comprising a neck region and a foot region;

a pillow assembly affixed thereto an upper end thereof said base assembly;

a plurality of storage means integral therewith said base assembly; and, a securing and transportation means for securing said sunbathing mat thereinto a rolled configuration;

wherein said pillow assembly is configurable between a straight configuration and a ring-shaped configuration defining a generally vertical opening adapted to accommodate portions of the head of a user; and, wherein said rolled configuration provides an ease of transporting said sunbathing mat.

2. The sunbathing mat of claim 1, wherein said base assembly further comprises:

an upper base cover;

a lower base cover removably attachable thereto said upper base cover therewith a base cover fastener; and, a torso pad for removable placement therebetween said upper base cover and said lower base cover;

wherein said upper base cover provides a protective and comfortable upper enclosure thereto said torso pad;

wherein said lower base cover provides a protective cover thereto said torso pad from ground surfaces;

wherein said torso pad comprises dimensions enabling a close fit therebetween said upper base cover and said lower base cover when interconnected therewith said base cover fastener.

3. The sunbathing mat of claim 2, wherein said upper cover further comprises a terrycloth material.

4. The sunbathing mat of claim 3, wherein said upper cover further comprises at least one (1) of the following list: a variety of colors, a variety of patterns, a logo, or personalized indicia.

5. The sunbathing mat of claim 2, wherein said lower base cover further comprises a rugged water-proof material.

6. The sunbathing mat of claim 5, wherein said lower base cover further comprises an abrasion resistant material thereon an outer surface.

7. The sunbathing mat of claim 6, wherein said lower cover further comprises at least one (1) of the following list: a variety of colors, a variety of patterns, a logo, or personalized indicia.

8. The sunbathing mat of claim 2, wherein said base cover fastener is affixed along an outer perimeter region of said upper base cover and an outer perimeter region of said lower base cover comprising a starting position adjacent to said neck region and terminating at said foot region.

9. The sunbathing mat of claim 2, wherein said base cover fastener further comprises a heavy-duty waterproof bi-directional zipper.

10. The sunbathing mat of claim 2, wherein said pillow assembly further comprises:

a pillow pad attached thereto a central location of said neck region thereof said torso pad and comprising a cylindrical shape;

a pillow pad cover, comprising:

a neck region cover portion;

a pair of pillow cover fasteners extending along a forward edge adjacent thereto said base assembly and terminating at an outer edge of said neck region cover portion; and, a pair of extension sections each comprising a generally triangle-shaped panel extending therefrom opposing upper horizontal edges thereof said upper base cover and securable therewith an extension section fastener thereto opposing lower outer surfaces of said pillow pad cover; and, a pair of pillow assembly fasteners affixed along outer end panels of said pillow cover;

wherein said pillow cover provides a protective and comfortable enclosure thereto said pillow pad;

wherein said pair of extension sections provide a protective and comforting means thereto a user from said ground surfaces;

wherein said pillow pad comprises a close fit therewithin said pillow pad cover when secured with said pair of pillow cover fasteners;

wherein said pillow assembly fasteners provide a means of securing said pillow assembly therein said ring-shaped configuration.

11. The sunbathing mat of claim 10, wherein said pillow cover further comprises a terrycloth material.

12. The sunbathing mat of claim 1 wherein said pillow cover further comprises at least one (1) of the following list: a variety of colors, a variety of patterns, a logo, or personalized indicia.

13. The sunbathing mat of claim 10, wherein said pair of pillow cover fasteners comprises a heavy-duty bi-directional waterproof zipper.

14. The sunbathing mat of claim 10, wherein said torso pad and said pillow pad comprise a unitary construction being partially separated therefrom one another thereat said neck region.

15. The sunbathing mat of claim 14, wherein said torso pad and said pillow pad comprise a polyurethane foam material.

16. The sunbathing mat of claim 2, wherein said plurality of storage means further comprise:

a beverage holder located thereat an intermediate location adjacent thereto an edge thereof said upper base cover and a beverage aperture therethrough said torso pad for receiving said beverage holder; and, a pocket located thereat an opposing intermediate location therefrom said beverage holder, further comprising a fastening securable therewith a pocket fastener.

17. The sunbathing mat of claim 2, wherein said plurality of storage means further comprises a storage compartment located thereon said foot region thereat a central location thereat an outer surface thereof said lower base cover, securable therewith a storage compartment fastener extending between upper lateral extremities of said storage compartment;

wherein said storage compartment is readily accessible when said sunbathing mat is in said rolled configuration.

18. The sunbathing mat of claim 17, wherein said storage compartment fastener further comprises a heavy-duty bi-directional waterproof zipper.

19. The sunbathing mat of claim 2, wherein said securing and transportation means further comprises:

a handle affixed thereto outer edges thereof said lower base cover;

a length adjuster located at a central position thereupon said handle;

a pair of straps each with a proximal end extending perpendicularly thereto said handle therefrom a lower edge of said lower base cover on opposing sides and a strap fastener thereat a distal end; and, a pair of lower base cover fasteners located thereon said foot region thereof an outer surface of said lower base cover;

wherein said length adjuster provides a length adjustment means therefor said handle; and, wherein said strap fastener thereof each of said pair of straps correspondingly mates therewith a lower base cover fastener when in said rolled configuration.

* * * * *